United States Patent [19]

Valiulis

[11] Patent Number: 4,850,557

[45] Date of Patent: Jul. 25, 1989

[54] HANGER ASSEMBLY WITH TWO-ARM HANGER AND MOUNTING BRACKET

[75] Inventor: Stanley C. Valiulis, Rockford, Ill.

[73] Assignee: Southern Imperial, Inc., Rockford, Ill.

[21] Appl. No.: 230,861

[22] Filed: Aug. 11, 1988

[51] Int. Cl.[4] ..... E04G 3/00

[52] U.S. Cl. ..... 248/220.4; 211/57.1; 211/59.1

[58] Field of Search ..... 248/220.4, 221.4, 221.2, 248/220.2, 221.1; 211/57.1, 59.1; 40/657, 124.1, 662, 16, 16.2, 16.4, 16.6, 19.5

[56] References Cited

U.S. PATENT DOCUMENTS

| | | | |
|---|---|---|---|
| 2,665,869 | 1/1954 | Samuels | 211/59.1 |
| 3,502,294 | 3/1970 | Kalbow | 248/220.4 X |
| 4,520,978 | 6/1985 | Taub | 211/57.1 X |
| 4,540,093 | 9/1985 | Merl | 211/59.1 |
| 4,671,417 | 6/1987 | O'Brien | 211/59.1 |
| 4,674,721 | 6/1987 | Thalenfeld | 211/59.1 X |
| 4,750,698 | 6/1988 | Barnes | 248/220.4 |
| 4,754,563 | 7/1988 | Fast | 40/657 X |

FOREIGN PATENT DOCUMENTS

| | | | |
|---|---|---|---|
| 708989 | 5/1954 | United Kingdom | 248/220.4 |

*Primary Examiner*—J. Franklin Foss

*Attorney, Agent, or Firm*—Leydig, Voit & Mayer

[57] ABSTRACT

A hanger assembly for displaying merchandise in front of a perforated panel includes two vertically spaced arms formed of plastic and molded integrally with a plate having a hook formed on its upper end. The hook is sized to interlock releasably with a single-piece mounting bracket adapted to be fastened releasably to the panel.

7 Claims, 1 Drawing Sheet

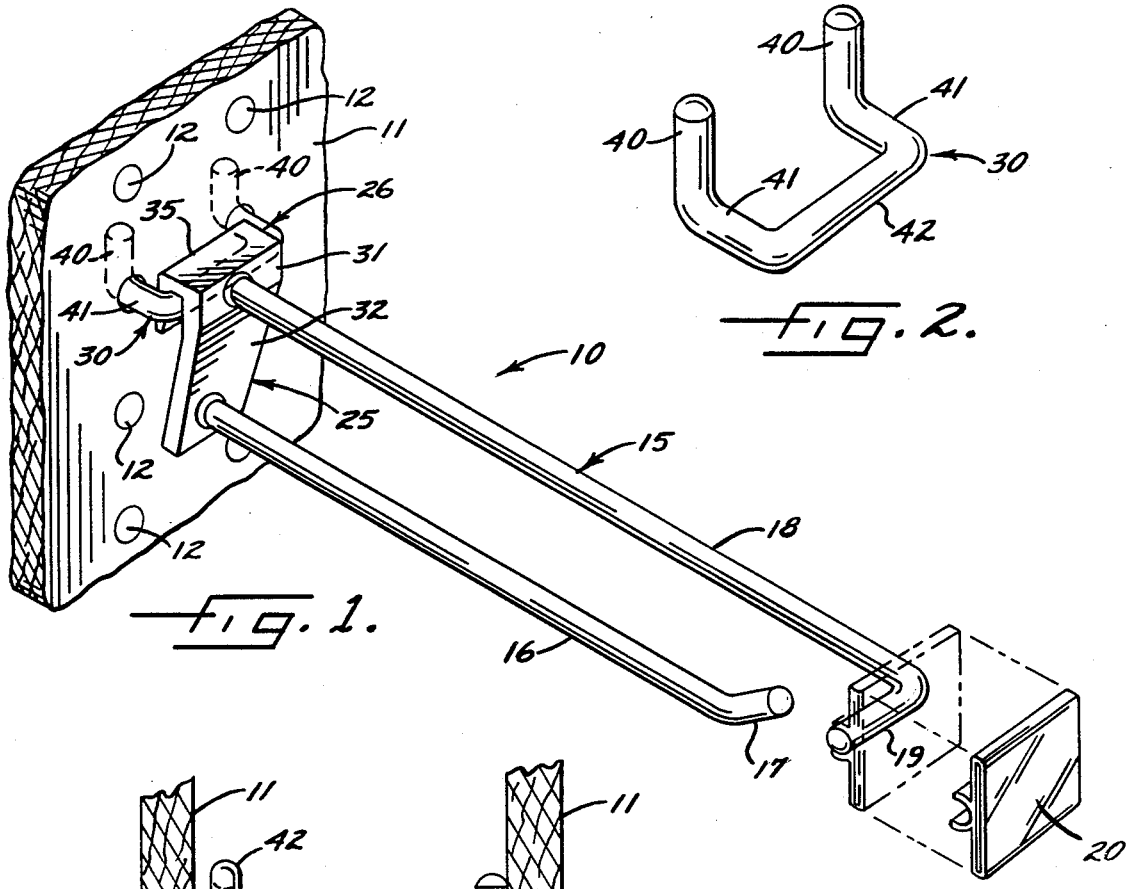
Fig. 1.
Fig. 2.
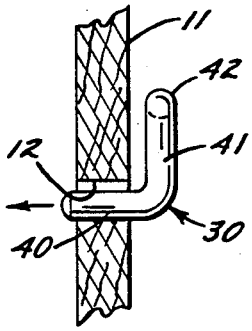
Fig. 3.
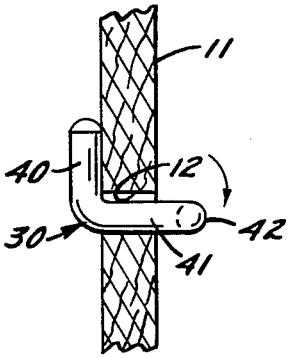
Fig. 4.
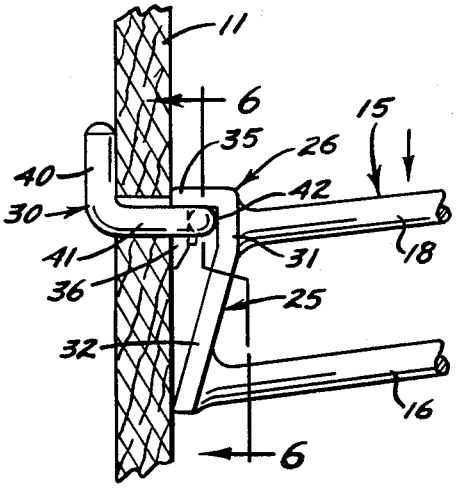
Fig. 5.
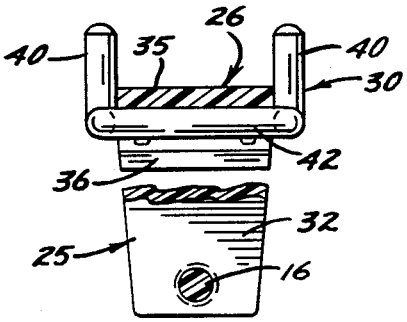
Fig. 6.

HANGER ASSEMBLY WITH TWO-ARM HANGER AND MOUNTING BRACKET

BACKGROUND OF THE INVENTION

This invention relates to a hanger assembly used to display merchandise in front of a perforated panel of the "Pegboard" type. Many of such hanger assemblies comprise an elongated hanger arm adapted to hold the merchandise and adapted to be fastened releasably to a mounting bracket which, in turn, may be attached releasably to the panel.

A popular hanger assembly of the foregoing type is disclosed in Valiulis U.S. Pat. No. 4,394,909. In that assembly, the hanger arm is formed by a bent piece of wire while the mounting bracket is molded of plastic.

In recent years, it has become conventional to provide a second elongated arm spaced above the merchandise arm and adapted to support a tag, label or the like containing price and inventory information which may be scanned by an electronic wand. Valiulis U.S. application Ser. No. 079,523, filed July 30, 1987 and assigned to the assignee of the present invention discloses a hanger assembly in which the hanger includes both a merchandise arm and an upper "scanning" arm. The hanger with the two arms is made of wire and is adapted to be attached to a plastic bracket similar to that disclosed in the Valiulis U.S. Pat. No. 4,394,909. Another two-arm hanger assembly in which the hanger is made of wire is disclosed in Barnes U.S. Pat. No. 4,452,360.

SUMMARY OF THE INVENTION

The general aim of the present invention is to provide a new and improved two-arm hanger assembly in which the hanger may be inexpensively molded from plastic and may be attached to a novel supporting bracket without need of turning the hanger to an upright position to effect the attachment.

A more detailed object is to achieve the foregoing through the provision of a plastic hanger having a hook adapted to interlock releasably with a bail-like bracket which may be attached quickly and conveniently to the panel.

The invention also resides in the unique construction of the hanger and the bracket and in the novel coaction between the two to hold the hanger in a stable position on the panel.

These and other objects and advantages of the invention will become more apparent from the following detailed description when taken in conjunction with the accompanying drawings.

BRIEF DESCRIPTION OF THE DRAWINGS

FIG. 1 is a perspective view showing a new and improved hanger assembly incorporating the unique features of the invention attached to a typical perforated panel.

FIG. 2 is a perspective view of the mounting bracket of the hanger assembly.

FIG. 3 is a cross-section taken through the panel and showing the mounting bracket being attached to the panel.

FIG. 4 is a view similar to FIG. 3 but shows the mounting bracket fully attached to the panel.

FIG. 5 is a view similar to FIG. 4 but shows the hanger of hanger assembly attached to the bracket.

FIG. 6 is a fragmentary cross-section taken substantially along the line 6—6 of FIG. 5.

DETAILED DESCRIPTION OF THE PREFERRED EMBODIMENT

For purposes of illustration, the hanger assembly 10 of the present invention has been shown in the drawings in conjunction with a perforated panel 11 of the "Pegboard" type. The panel is disposed in a vertical plane and is formed with vertically spaced rows of horizontally spaced holes 12 which extend between the front and rear sides of the panel.

The hanger assembly 10 includes a hanger 15 having an elongated and generally horizontal hanger arm 16 which extends forwardly from the panel 11. Various types of merchandise, either packaged or unpackaged, may be hung from the arm and displayed in front of the panel. The extreme forward end portion of the arm is turned upwardly as indicated at 17 to help retain the merchandise on the arm.

In addition to the merchandise arm 16, the hanger 15 preferably includes a second generally horizontal arm 18 spaced above the arm 16 and extending forwardly from the panel 11 to a point somewhat beyond the outer end 17 of the arm 16. The outer end portion of the arm 18 is formed with a laterally extending section 19 adapted to support a transparent plastic holder 20 which encloses a tag printed with a price, stock number or other information relating to the merchandise on the arm 16.

In accordance with the present invention, the arms 16 and 18 are made of plastic and are molded integrally with a plate 25 which is formed with a unique hook 26 adapted to secure the hanger 15 releasably to a bracket 30. The bracket, in turn, is of a simple and inexpensive one-piece construction and may be attached to and detached from the panel 11 in a quick and easy manner.

More specifically, the plate 25 of the hanger 15 is molded from a suitable resiliently yieldable plastic such as polypropylene, is disposed in face-to-face relation with the outer side of the panel 11, and includes an upper end portion 31 (FIG. 5) which is disposed in a generally vertical plane. The rear end portion of the arm 18 is molded integrally with the forward face of the upper end portion 31 of the plate 25.

The plate 25 also includes a lower end portion 32 (FIG. 5) which is integral with the rear end of the merchandise arm 16. The lower plate portion 32 extends downwardly from the upper plate portion 31 and slopes rearwardly toward the panel 11 upon progressing downwardly. For a purpose which will become clear subsequently, the lower edge portion of the inclined lower plate portion 32 engages the front face of the panel when the hanger 15 is fully installed.

As shown most clearly in FIG. 5, the hook 26 of the hanger 15 includes a horizontal portion 35 molded integrally with and extending rearwardly from the upper end of the plate 25. The hook further includes a vertical portion 36 formed integrally with and projecting downwardly from the rear end of the hook portion 35 and disposed in spaced parallel relation with the plate portion 31.

Pursuant to the invention, the bracket 30 is a one-piece member having a pair of horizontally spaced and vertically extending horns 40. Horizontal fingers 41 project forwardly from the lower portions of the horns and have forward portions joined integrally with a horizontal bridge 42 which extends laterally between the fingers. The horns, the fingers and the bridge may either be formed from a single piece of round wire or may be molded from plastic.

To attach the hanger assembly 10 to the panel 11, the bracket 30 first is positioned in front of the panel in the orientation shown in FIG. 3 and the horns 40 are horizontal and point toward the panel. The bracket 30 then is moved rearwardly to insert the horns into two of the holes 12. While still being pushed, the bracket is rocked clockwise to the position shown in FIG. 4 to cause the fingers 41 to move into the holes and to cause the horns to move to vertical positions in which the horns hook behind the rear face of the panel. In the installed position of the bracket, the fingers 41 extend forwardly through the holes 12 while the bridge 42 is spaced forwardly from the panel. The fingers 41 and the bridge 42 coact with the panel 11 to define an eye for receiving the downwardly extending portion 36 of the hook 26.

After the bracket 30 has been installed on the panel 11 in the position shown in FIG. 4, the hanger 15 is attached to the bracket. This is achieved simply by moving the hanger downwardly to insert the downwardly extending portion 36 of the hook 26 into the eye defined by the panel 11, the fingers 41 and the bridge 42. When the hook portion 36 is inserted into the eye, the rearwardly extending portion 35 of the hook 26 rests on the bridge 42 to limit downward shifting of the hanger while the lower edge of the rearwardly inclined portion 32 of the plate 25 engages the front of the panel to limit clockwise pivoting of the hanger on the bridge. The hanger thus is supported in a stable position and its weight keeps the bracket 30 located in the position shown in FIG. 5. To help insure a stable mounting, the thickness of the downwardly extending hook portion 36 is just slightly less than the spacing between the bridge 42 and the panel 11 while the spacing between the plate portion 31 and the hook portion 36 is just slightly greater than the diameter of the bridge. If desired, such spacing may, in the relaxed condition of the plastic, be slightly less than the diameter of the bridge so as to cause the bridge to be gripped with a snap fit.

From the foregoing, it will be apparent that the present invention brings to the art a new and improved hanger assembly 10 in which the two-arm hanger 15 is molded of plastic and in which the bracket 30 is of a very low cost single-piece construction. By virtue of the bracket, the hanger 15 may be attached to the panel 11 without need of turning the hanger to an upright position. Thus, the hanger may be installed even though there is merchandise or another hanger in close overhead proximity to the hanger.

I claim:

1. A hanger assembly for displaying merchandise from the front face of a perforated panel disposed in a generally vertical plane and having vertically spaced rows of horizontally spaced holes, said assembly comprising a hanger having an elongated and generally horizontal arm with front and rear ends, a generally upright plate joined to the rear end of said arm, and a hook having a generally horizontal portion joined to and projecting rearwardly from the upper end portion of said plate and having a generally vertical portion joined to and projecting downwardly from the rear end of said generally horizontal portion, said generally vertical portion of said hook being substantially shorter than said plate, said hanger assembly further comprising a bracket adapted to be attached releasably to said panel and adapted to releasably support said hanger, said bracket comprising a pair of horizontally spaced and generally vertically extending horns adapted to be inserted through a pair of holes in one of said rows and having upper end portions adapted to hook against the rear face of said panel, said bracket further comprising generally horizontal fingers adapted to extend forwardly through said pair of holes and having rear ends joined to the lower ends of said horns, and a generally horizontal bridge joined to and extending between the forward ends of said fingers and spaced forwardly from said panel so as to coact with said panel and said fingers to define an eye for receiving the generally vertical portion of said hook when said hanger is positioned with the generally horizontal portion of said hook resting on said bridge, the upper end portion of said plate being disposed in a substantially vertical plane and extending substantially parallel to the front face of said panel, said plate including a lower portion inclined so as to slope rearwardly toward said panel upon progressing downwardly and having a lower edge portion adapted to engage the front face of said panel in order to keep the upper end portion of the plate in said substantially vertical plane.

2. A hanger assembly as defined in claim 1 in which said horns, said fingers and said bridge of said bracket are formed integrally with one another.

3. A hanger assembly as defined in claim 2 in which said horns, said fingers and said bridge are formed from a single piece of round wire.

4. A hanger assembly as defined in claim 2 in which said horns, said fingers and said bridge are molded of plastic.

5. A hanger assembly as defined in claim 1 further including a second elongated and generally horizontal arm spaced vertically from said one arm and having a rear end joined to said plate.

6. A hanger assembly for displaying merchandise from the front side of a perforated panel disposed in a generally vertical plane and having vertically spaced rows of horizontally spaced holes, said assembly comprising a hanger having:

(a) an elongated and generally horizontal arm adapted to project forwardly from said panel and having front and rear ends;

(b) a generally upright plate adapted to be positioned in face-to-face relation with the front side of said panel and joined integrally with the rear end of said arm, said plate having an upper end portion located in a generally vertical plane and having a lower end portion which slopes rearwardly upon progressing downwardly from said upper end portion whereby the lower end of said plate may engage the front face of the panel to hold the upper end portion of said plate in said generally vertical plane and in forwardly spaced relation with said panel; and (c) a hook having a generally horizontal portion joined integrally with end projecting rearwardly from the upper end portion of said plate and having a generally vertical portion joined integrally with and projecting downwardly from said generally horizontal portion, said generally vertical portion of said hook being substantially shorter than said plate;

said hanger assembly further comprising a bracket adapted to be attached releasably to said panel and adapted to releasably support said hanger; said bracket comprising:

(a) a pair of horizontally spaced horns adapted to be inserted through a pair of holes in one of said rows and having upper end portions adapted to hook against the rear face of said panel;

(b) generally horizontal fingers adapted to extend forwardly through said pair of holes and having rear ends joined to the lower ends of said horns; and (c) a generally horizontal bridge joined to and extending between the forward ends of said fingers and spaced forwardly from said panel so as to coact with said panel and said fingers to define an eye for receiving the generally vertical portion of said hook when said hanger is positioned with the generally horizontal portion of said hook resting on said bridge.

7. A hanger assembly as defined in claim 6 in which said hanger is of single-piece construction and is molded of resiliently yieldable plastic, the front-to-rear spacing between said upper end portion of said plate and said generally vertical portion of said hook being slightly less than the front-to-rear dimension of said bridge when said plastic is in a relaxed condition.

* * * * *